US006484655B1

(12) United States Patent
Gibson

(10) Patent No.: US 6,484,655 B1
(45) Date of Patent: Nov. 26, 2002

(54) SYNCHRONOUS CABLE TRANSMISSION SYSTEM FOR BOAT LIFTS

(76) Inventor: Randolph P. Gibson, 2668 Waxwood Ct., Clearwater, FL (US) 33761

( * ) Notice: Subject to any disclaimer, the term of this patent is extended or adjusted under 35 U.S.C. 154(b) by 0 days.

(21) Appl. No.: 10/063,381

(22) Filed: Apr. 17, 2002

(51) Int. Cl.[7] ..... B63C 7/00
(52) U.S. Cl. ..... 114/44
(58) Field of Search ..... 114/44–48; 405/3–7

(56) References Cited

U.S. PATENT DOCUMENTS 1,061,213 A * 5/1913 Arbuckle ..... 114/48
6,230,639 B1 * 5/2001 McLaughlin et al. ..... 114/44
6,408,776 B1 * 6/2002 McLaughlin et al. ..... 114/44

* cited by examiner

*Primary Examiner*—Ed Swinehart
(74) *Attorney, Agent, or Firm*—Ronald E. Smith; Smith & Hopen, PA

(57) ABSTRACT

A three piling boatlift includes an inboard piling to which is secured a master/slave cable assembly. A first master cable extends from a first end of a master drum to a first outboard piling and a second master cable extends from a second end of the master drum to a second outboard piling. A first slave cable extends from a first end of a slave drum to a first inboard end of a boat lift cradle and a second slave cable extends from a second end of the slave drum to a second inboard end of the boat lift cradle. The slave drum is interconnected to the master drum so that winch-driven rotation of the master drum effects simultaneous and corresponding rotation in the slave drum. The weight of a boat lifted by the boatlift is distributed equally between four cables and all four cables are wound and unwound in synchronization with one another.

12 Claims, 7 Drawing Sheets

SYNCHRONOUS CABLE TRANSMISSION SYSTEM FOR BOAT LIFTS

BACKGROUND OF INVENTION

1. Field of the Invention

This invention relates, generally, to boat lifts. More particularly, it relates to a four-cable boatlift having a master/slave cable system.

2. Description of the Prior Art

Lifting a boat from the water with a piling-mounted boatlift is problematic. Typically, a winch is used to wrap cables around drums when a boat is lifted and to unwrap the cables from the drums when a boat is lowered. Many boatlifts provide one winch for each cable, there being a winch on each piling. In addition to the expense of four winches, systems of this type also have the drawback caused by different winches operating at differing speeds. Thus, if one of the four winches operates slower or faster than the others, the boat will be unevenly lifted.

Some systems therefore use two winches, one for the inboard (dockside) end of the boatlift and one for the outboard end thereof. Still, if the two winches do not operate at the same speed, an uneven lift occurs. Uneven lifts are undesirable because a boat supported unevenly may slide from the boatlift.

Three piling systems are introduced by the present inventor in a co-pending U.S. patent application entitled "Three Piling Boat Lift" filed Jan. 3, 2001, bearing Ser. No. 09/681,095. However, that system also relies upon two independent winches.

What is needed, then, is a cable transmission system that synchronizes the winding and unwinding of cables around their respective drums so that boats are lifted evenly.

However, in view of the prior art considered as a whole at the time the present invention was made, it was not obvious to those of ordinary skill in the pertinent art how such need could be fulfilled.

SUMMARY OF INVENTION

The long-standing but heretofore unfulfilled need for a synchronous cable transmission system for lifting boats is now met by a new, useful, and nonobvious invention.

A three piling boatlift embodiment of the invention includes an upstanding inboard piling and a pair of upstanding outboard pilings disposed in transversely spaced apart relation to the inboard piling and in longitudinally spaced apart relation to one another. A truncate rigid plate is positioned in closely spaced relation to the inboard piling and in substantially parallel relation to the pair of outboard pilings. A first beam has an inboard end secured to a first end of the truncate rigid plate and an outboard end disposed in closely spaced relation to a first outboard piling of the pair of outboard pilings. A second beam has an inboard end secured to a second end of the truncate rigid plate and an outboard end disposed in closely spaced relation to a second outboard piling of the pair of outboard pilings.

A cable drum assembly is mounted to the inboard piling near an upper end thereof in vertically spaced relation to the truncate rigid plate and includes a longitudinally disposed master cable drum and a slave cable drum disposed in transversely spaced apart, parallel relation to the master cable drum. The master cable drum and the slave cable drum are disposed in a common horizontal plane. A motor means rotates the master cable drum. An interconnecting means translates rotation of the master cable drum into simultaneous and corresponding rotation of the slave drum.

A first master cable extends from a first end of the master cable drum to the first piling of the pair of outboard pilings and is adapted to lift the outboard end of the first beam when the master cable drum is rotated in a first direction and to lower the outboard end of the first beam when the master cable drum is rotated in a second direction. A second master cable extends from a second end of the master cable drum to the second piling of the pair of outboard pilings and is adapted to lift the outboard end of the second beam when the master cable drum is rotated in a first direction and to lower the outboard end of the second beam when the master cable drum is rotated in a second direction.

A first slave cable extends from a first end of the slave cable drum to a first end of the truncate rigid plate and is adapted to lift the inboard end of the first beam when the slave cable drum is rotated in a first direction and to lower the inboard end of the first beam when the slave cable drum is rotated in a second direction. A second slave cable extends from a second end of the slave cable drum to a second end of the truncate rigid plate and is adapted to lift the inboard end of the second beam when the slave cable drum is rotated in a first direction and to lower the second beam when the slave cable is rotated in a second direction.

The weight of a boat lifted and lowered by the boatlift is therefore distributed substantially equally between the first and second master cables and the first and second slave cables. Moreover, all of the cables are in synchronization with one another so that the boatlift is lifted and lowered in a substantially level plane.

The primary object of this invention is to provide a synchronous cable transmission system where all of the cables in the system are synchronized with respect to one another to avoid uneven boat lifting.

A more particular object is to provide a boatlift where a single winch drives a single master cable drum and all parts connected thereto.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
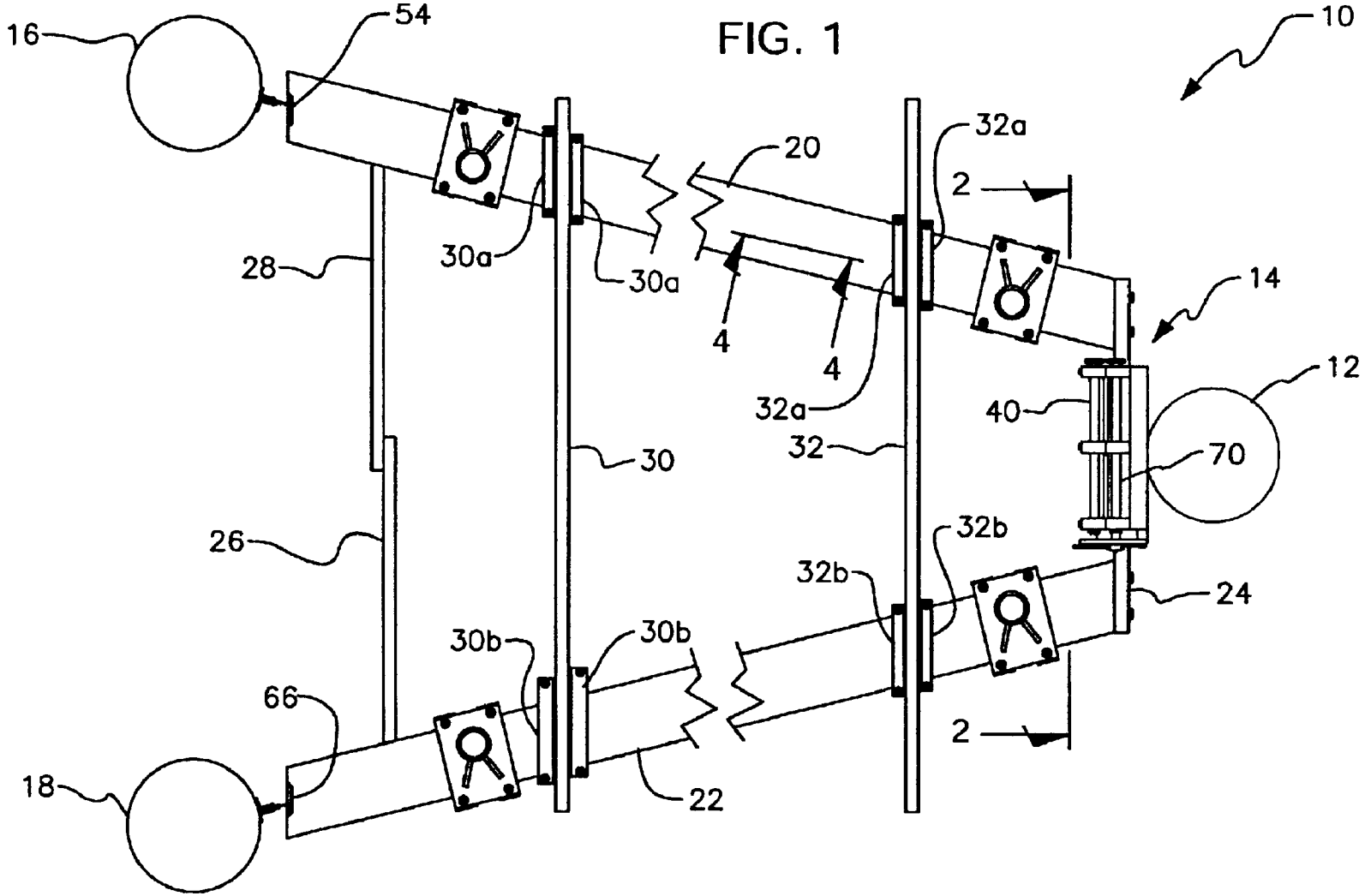
FIG. 1 is a top plan view of a three piling boat lift including the master/slave cable assembly of this invention.

Referring to the top plan view of FIG. 1, it will there be seen that the reference numeral 10 denotes an illustrative embodiment of a boat lift having three supporting pilings. Inboard piling 12 supports master/slave cable apparatus 14 near an uppermost end thereof. Outboard pilings 16, 18 support the outermost ends of first cradle box beam 20 and second cradle box beam 22, respectively. Truncate rigid plate 24 interconnects the respective inboard ends of box beams 20, 22 and rigid interconnecting arms 26, 28, interconnect the respective outboard ends of said box beams. The depicted overlapping of said interconnecting arms indicates their adjustability, it being understood that the spacing between pilings 16, 18 may differ from dock to dock.

Parallel, longitudinally aligned bunk boards 30, 32 are padded so that they do not mar the hull of a boat supported thereby when novel cradle assembly 10 is lifted.

Mounting blocks 30*a*, 30*a* and 30*b*, 30*b* secure opposite ends of bunk board 30 and mounting blocks 32*a*, 32*a* and 32*b*, 32*b* secure opposite ends of bunk board 32.

Figure 2:
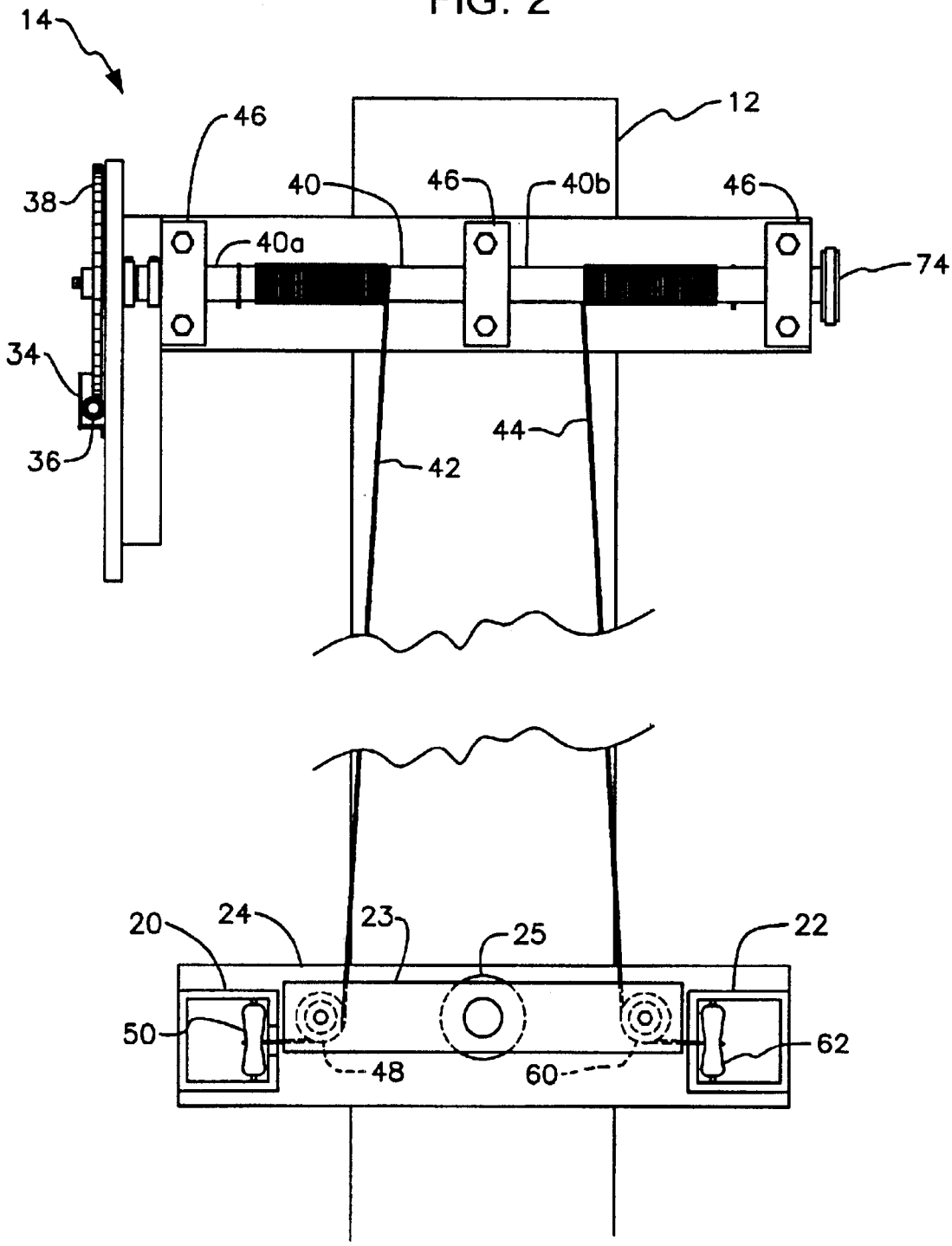
FIG. 2 is a view taken along line 2—2 in FIG. 1.

Master/slave cable apparatus 14 is depicted in front elevation and in greater detail in FIG. 2. Worm housing 34 houses motor-driven worm 36 that meshingly engages worm gear 38. Rotation of worm gear 38 effects simultaneous and corresponding rotation of master drum 40 about which master cables 42 and 44 are wound. Master drum 40 is rotatably supported at its opposite ends and at its mid-point by bearing blocks, collectively denoted 46.

Master cable 42 extends straight down from a first end 40*a* of master drum 40 to first inboard pulley 48. Pulley 48 is disposed in sandwiched relation between a pair of parallel plates 23, 23, only one of which is seen in the front elevational view of FIG. 2. Those plates are rotatably mounted to truncate rigid plate 24. This rotatable mounting serves to equalize the load shared by the slave cables when supporting a boat, as explained in co-pending U.S. patent application Ser. No. 09/681,095 to the present inventor, entitled "Three Piling Boat Lift," which is hereby incorporated by reference into this disclosure.

Master cable 42 bends about ninety degrees around first inboard pulley 48 and therefore extends in a substantially horizontal plane to first cradle beam 20. It executes a bend around first inboard roller 50 at the inboard end of said box beam 20 and travels through the hollow interior of said box beam until it reaches outboard piling 16. First inboard pulley 48 is mounted for rotation about a horizontal axis and first inboard roller 50 is mounted for rotation about a vertical axis.

Figure 3:
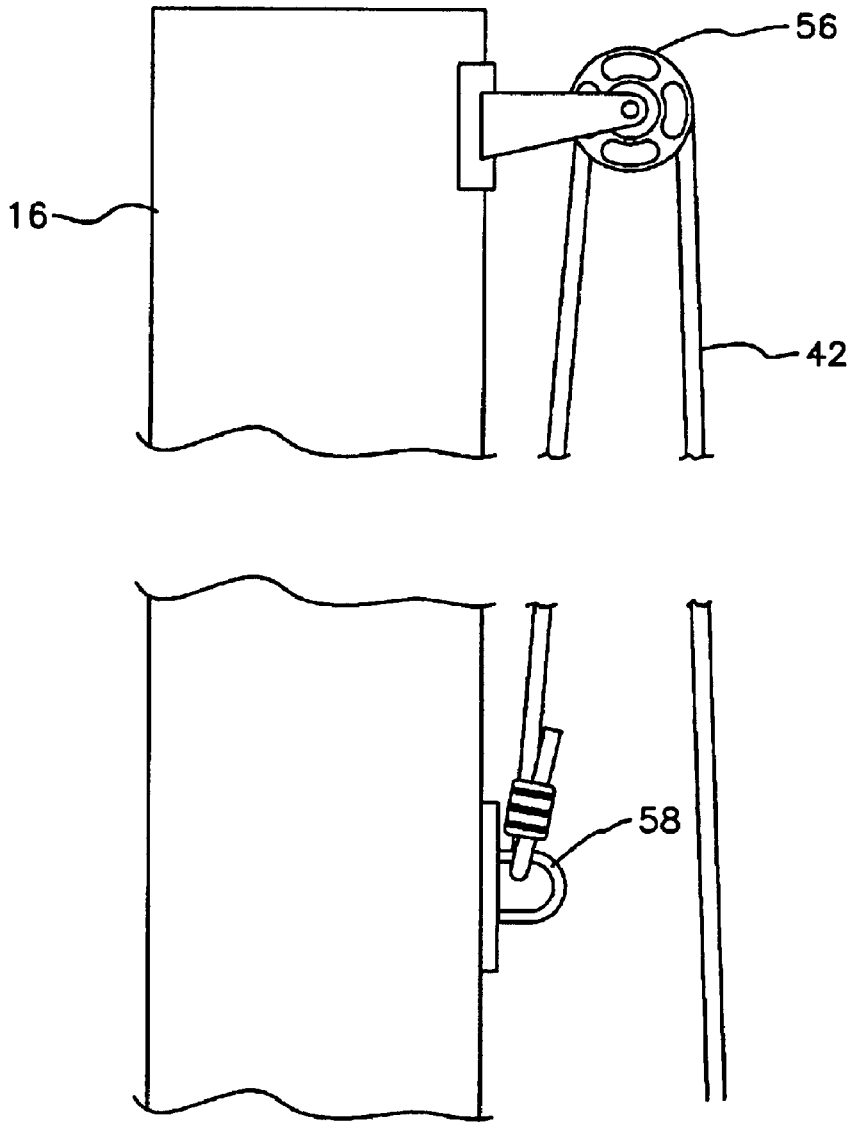
FIG. 3 is a side elevational view of an outboard piling.
Figure 4:
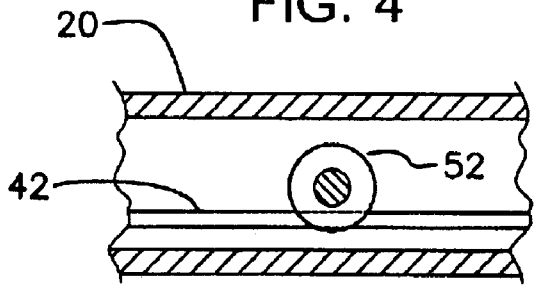
FIG. 4 is a sectional view taken along line 4—4 in FIG. 1.

More particularly, as perhaps best understood in connection with FIGS. 1, 3, and 4, master cable 42, when within the hollow interior of box beam 20, extends under first box beam roller 52 (FIG. 4) which is rotatably mounted within the hollow interior of box beam 20. Master cable 42 then passes under first outboard roller 54 at the outboard end of box beam 20 (FIG. 1), exits the outboard end of box beam 20, and then extends upwardly as depicted in FIG. 3 to rotatably mounted first outboard pulley 56 positioned near the top of outboard piling 16. It wraps around first outboard pulley 56 and extends downwardly to first anchor means 58 to which the distal end of master cable 42 is secured.

Master cable 44 bends about ninety degrees around second inboard pulley 60 (FIG. 2) and therefore extends in a substantially horizontal plane to second box beam 22. It executes a bend around second inboard roller 62 at the inboard end of said box beam 22 and travels through the hollow interior of said box beam until it reaches outboard piling 18. Second inboard pulley 60 is mounted for rotation about a horizontal axis and second inboard roller 62 is mounted for rotation about a vertical axis.

More particularly, as perhaps best understood in connection with FIGS. 1, 3, and 4, master cable 44, when within the hollow interior of box beam 22, extends under a second box beam roller just like first box beam roller 52 of FIG. 4. Master cable 44 then passes under second outboard roller 66 at the outboard end of box beam 22 (FIG. 1), exits the outboard end of box beam 22, and then extends upwardly to a rotatably mounted second outboard pulley just like first outboard pulley 56 of FIG. 3, which second outboard pulley is positioned near the top of outboard piling 18. It wraps around the second outboard pulley and extends downwardly to a second anchor means which is just like first anchor means 58 but which is mounted on outboard piling 18 to which the distal end of master cable 44 is secured.

First master cable 42 therefore extends along a path of travel from first end 40*a* of said master cable drum 40 to said first inboard pulley 48, first inboard roller 50, first box beam roller 52, first outboard roller 54, first outboard pulley 56, and first anchor means 58.

Second master cable 44 extends along a path of travel from second end 40*b* of said master cable drum 40 to second inboard pulley 60, second inboard roller 62, a second box beam roller like first box beam roller 52, second outboard roller 66, a second outboard pulley like first outboard pulley 56, and a second anchor means like first anchor means 58.

Figure 5:
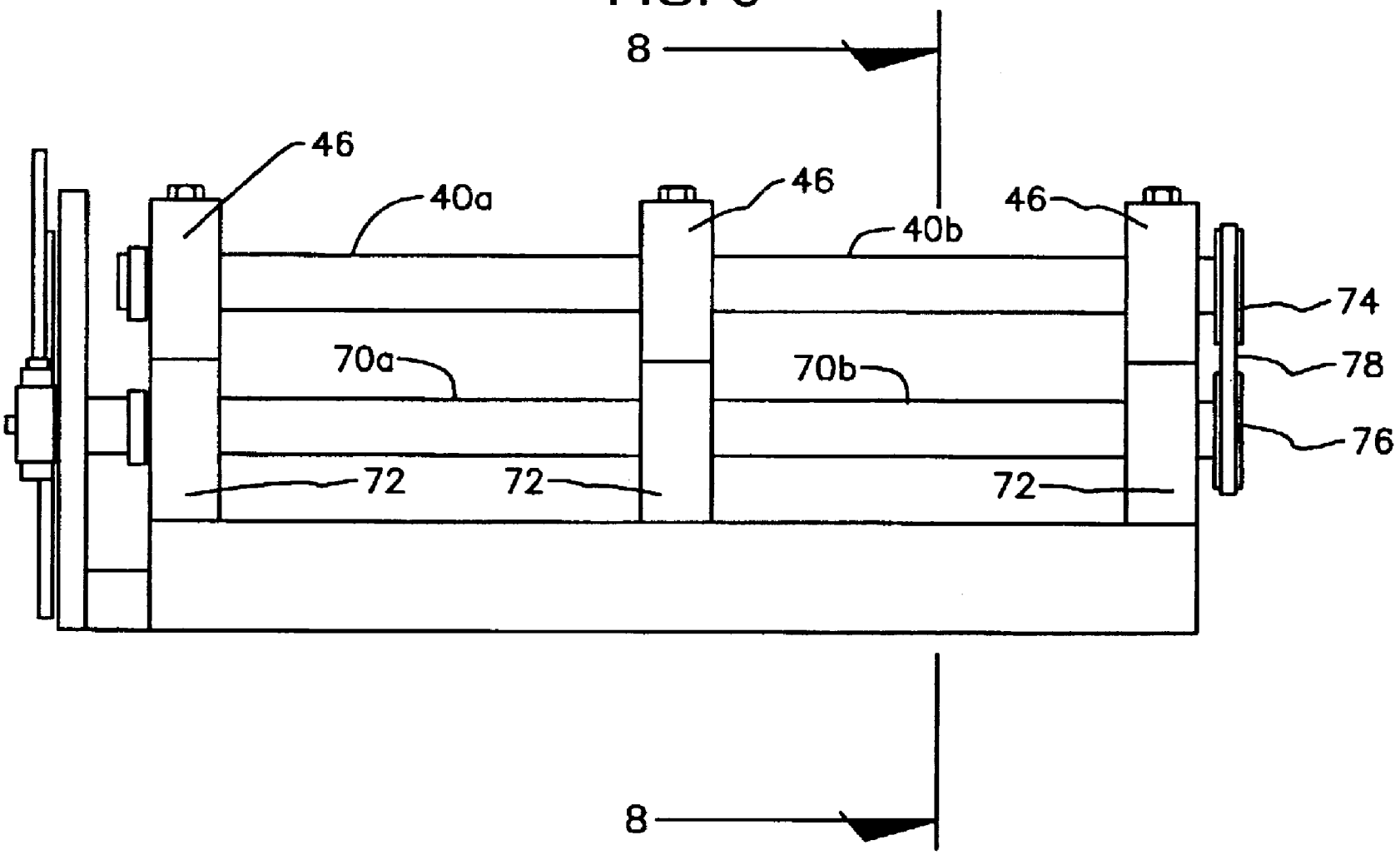
FIG. 5 is a top plan view of the novel master/slave cable assembly.

Slave drum 70 is depicted in FIG. 1 but is best depicted in the top plan view of FIG. 5. It is rotatably supported at its opposite ends and mid-point by bearing blocks, collectively denoted 72. It is mounted in the same horizontal plane as master drum 40.

Master wheel 74 is mounted to a free end of master drum 40 for conjoint rotation therewith and a slave wheel 76 is mounted to a free end of slave drum 70 for conjoint rotation with said slave drum. Belt 78 joins wheels 74 and 76 so that rotation of master wheel 74 effects simultaneous and corresponding rotation of slave wheel 76, i.e. , belt 78 synchronizes the rotation of wheels 74, 76 and thus synchronizes master drum 40 and slave drum 70.

Slave cables, not shown, extend from slave drum 70 to opposite ends of truncate rigid plate 24. Accordingly, motor-driven rotation of master drum 40 effects simultaneous and corresponding rotation of slave drum 70 so that the respective outboard ends of box beams 20 and 22 are lifted and lowered in correspondence with their respective inboard ends.

Figure 6:
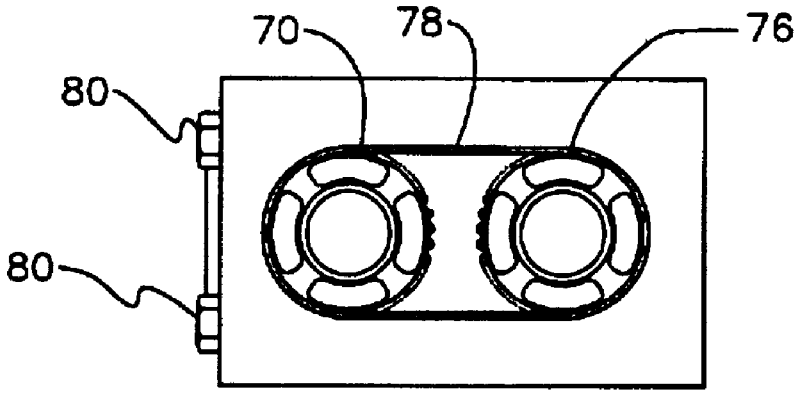
FIG. 6 is an end view of the novel master/slave cable assembly.
Figure 7:
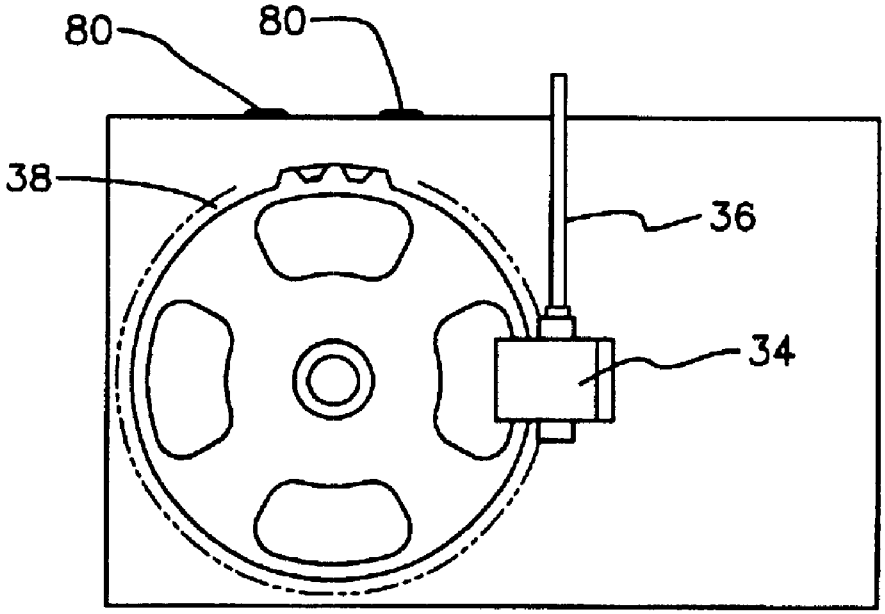
FIG. 7 is an end view of the worm and worm gear that rotates the master cable drum.
Figure 8:
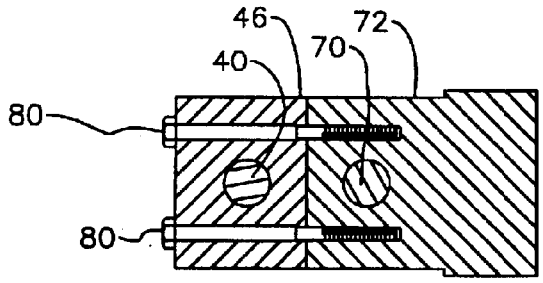
FIG. 8 is a sectional view taken along line 8—8 in FIG. 5.

FIG. 6 provides an end view of master wheel 74, slave wheel 76 and belt 78 and FIG. 7 provides an end view of worm housing 34, worm 36, and worm gear 38. FIG. 8 is a sectional view taken along line 8—8 in FIG. 5 and depicts how mounting blocks 46, 72 are secured to one another by elongate screws collectively denoted 80.

Figure 9:
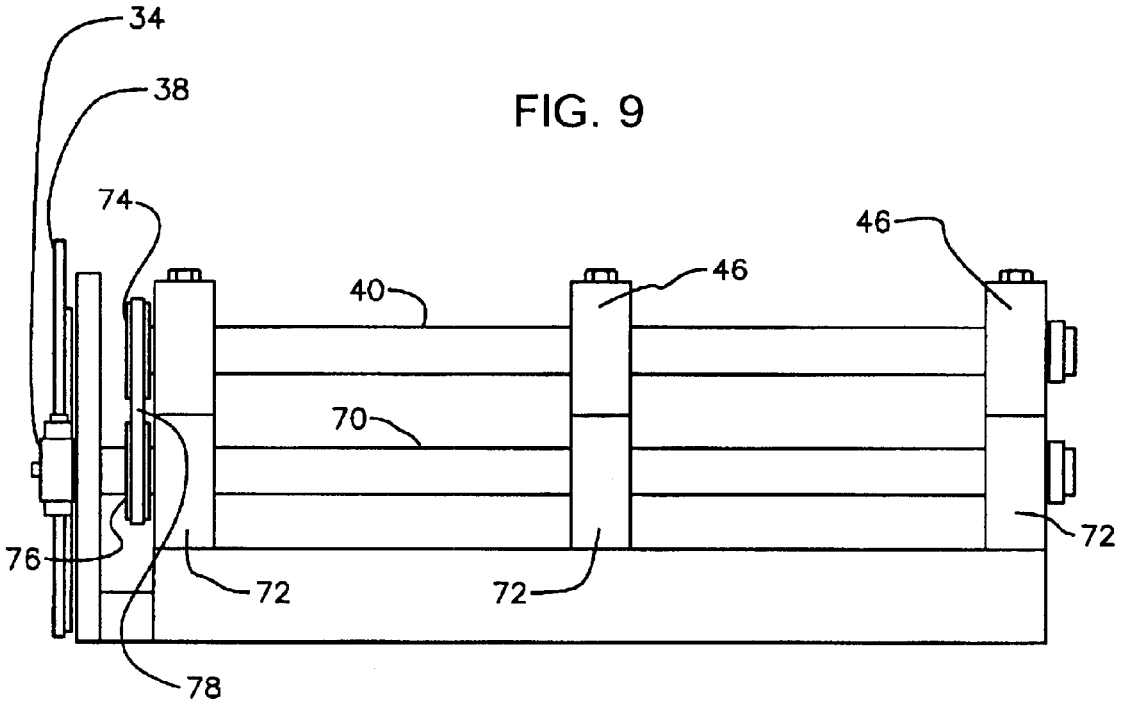
FIG. 9 is a top plan view depicting an alternative embodiment of the novel master/slave cable assembly.

In the alternative embodiment of FIG. 9, master wheel 74, slave wheel 76, and belt 78 are positioned at the winch end of the assembly. The FIG. 5 embodiment is preferred because the winch assembly in that embodiment does not block access to said wheels 74, 76, and belt 78.

Significantly, there are four cables (master cables 42, 44 and the two slave cables), even though there are only three pilings. The unique structure disclosed herein ensures that the weight of the boatlift and a boat lifted thereby is equally distributed between the four cables and that the cables will deploy and retract in synchronization with one another.

Figure 10:
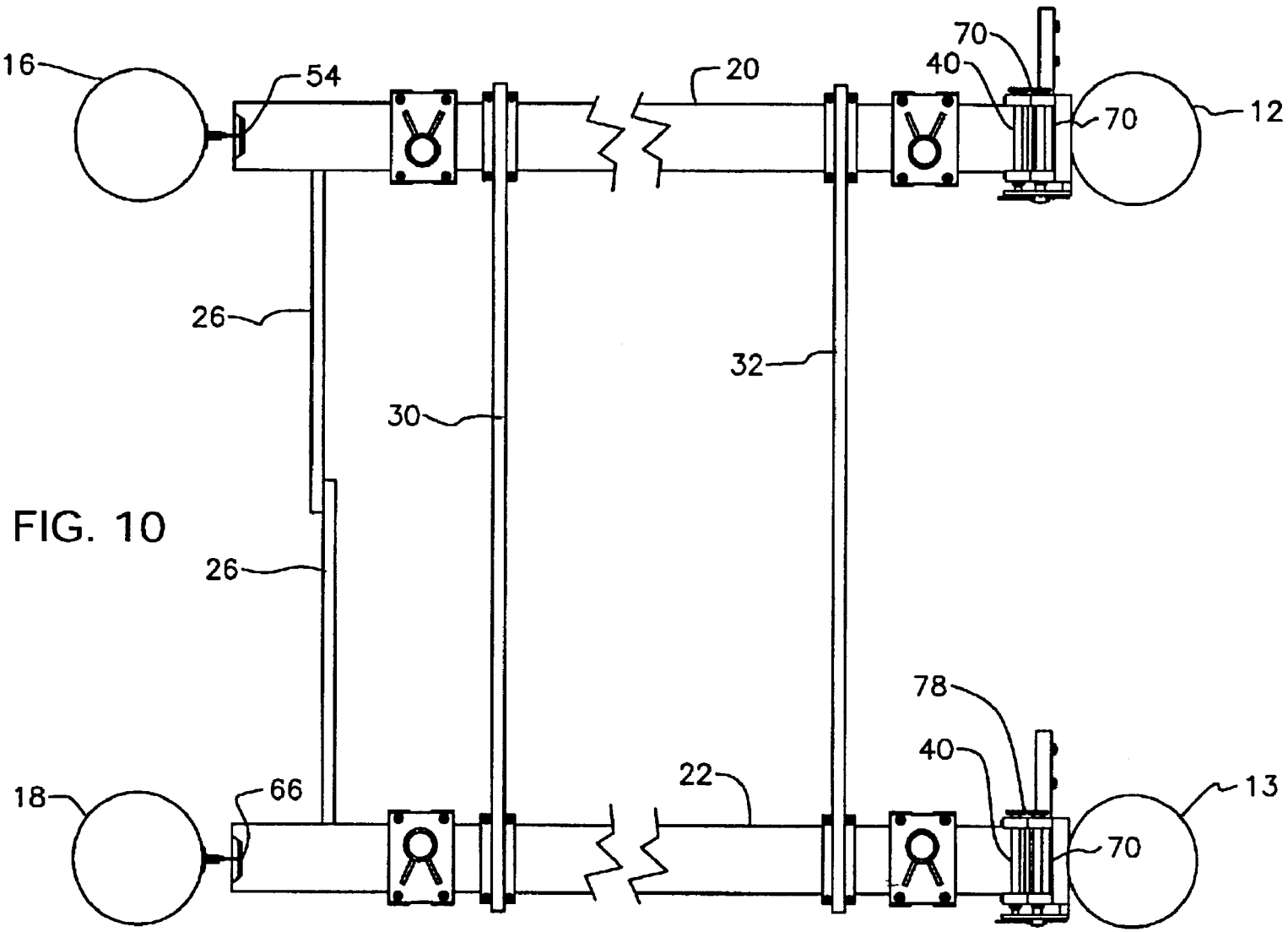
FIG. 10 is a top plan view of a four piling boat lift including an alternative embodiment of the novel master/slave cable assembly.

In the embodiment of FIG. 10, four pilings 12, 13, 16, and 18 are deployed in a well-known rectangular array. No truncate rigid plate 24 is employed, nor are there parallel plates 23, 23, inboard pulleys 48, 50, or inboard rollers 50, 62.

Box beam 20 includes box beam roller 52 and box beam 22 includes a box beam roller just like roller 52. Moreover, outboard pilng 16 provides a mount for first outboard pulley 56 and first anchor means 58 and outboard piling 18 provides a mount for its counterparts of said first outboard pulley and said first anchor means.

As to piling 12, a first master cable has a first end secured to master cable drum 40. Said first master cable extends downwardly from said drum 40 to the inboard end of box beam 20 where a first horizontally mounted roller is positioned so that said master cable can bend ninety degrees and enter into the hollow interior of box beam 20. The master cable then extends under box beam roller 52 within said hollow interior, first outboard roller 54 at the outboard end of box beam 20, up to first outboard pulley 56 mounted near the top of piling 16, and down to first anchor means 58 secured to piling 16 near a lower end thereof.

As to piling 13, a second master cable has a first end secured to master cable drum 40. Said second master cable extends downwardly from said drum 40 to the inboard end of box beam 22 where a second horizontally mounted roller is positioned so that said master cable can bend ninety degrees and enter into the hollow interior of box beam 22. The master cable then extends under a box beam roller like roller 52 within said hollow interior, second outboard roller 66 at the outboard end of box beam 22, up to a second outboard pulley like pulley 56 mounted near the top of piling 16, and down to a second anchor means like first anchor means 58 secured to piling 16 near a lower end thereof.

The slave cables having their respective first ends secures to slave drums 70, 70 have their respective second ends secured to the respective inboard ends of box beams 20, 22.

In all other respects, the embodiment of FIG. 10 operates like the first-described embodiment. The master and slave cables are played out and reeled in in synchronization with each other due to the interconnection of the master and slave drums 40 and 70 by belts 78.

In both embodiments, instead of interconnecting master and slave drums 40 and 70 by the wheel and belt arrangement described and depicted herein, said master and slave drums could be interconnected by meshing gears that supplant wheels 74 and 76. However, such gears would probably generate more noise than the preferred belt and wheel interconnection and thus would not represent a preferred embodiment. However, any means for simultaneously and correspondingly transmitting the rotation of master drum 40 to slave drum 70, or vice versa, is within the scope of this invention.

Moreover, it should be observed that master cables 42, 44 could also be mounted on slave drum 70*a*, 70*b* and the slave cables could be mounted on master drum 40*a*, 40*b*. The terms "master" and "slave" are arbitrary in that the master and slave cables can be reversed in position and still perform their respective functions as described herein. The important point is that only one of the drums is directly driven by a winch and that the other drum is indirectly driven thereby so that the cables wrapped around the respective drums are in synchronization with one another.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A three piling boatlift, comprising:

an upstanding inboard piling;

a pair of upstanding outboard pilings disposed in transversely spaced apart relation to said inboard piling and in longitudinally spaced apart relation to one another;

a truncate rigid plate positioned in closely spaced relation to said inboard piling and in substantially parallel relation to said pair of outboard pilings;

a first beam having an inboard end secured to a first end of said truncate rigid plate and an outboard end disposed in closely spaced relation to a first outboard piling of said pair of outboard pilings;

a second beam having an inboard end secured to a second end of said truncate rigid plate and an outboard end disposed in closely spaced relation to a second outboard piling of said pair of outboard pilings;

a cable drum assembly mounted to said inboard piling near an upper end thereof in vertically spaced relation to said truncate rigid plate;

said cable drum assembly including a longitudinally disposed master cable drum and a slave cable drum disposed in transversely spaced apart, parallel relation to said master cable drum, said master cable drum and said slave cable drum being disposed in a common horizontal plane;

motor means for rotating said master cable drum;

interconnecting means for translating rotation of said master cable drum into simultaneous and corresponding rotation of said slave drum;

a first master cable extending from a first end of said master cable drum to said first piling of said pair of outboard pilings, said first master cable adapted to lift said outboard end of said first beam when said master cable drum is rotated in a first direction and to lower said outboard end of said first beam when said master cable drum is rotated in a second direction;

a second master cable extending from a second end of said master cable drum to said second piling of said pair of outboard pilings, said second master cable adapted to lift said outboard end of said second beam when said master cable drum is rotated in a first direction and to lower said outboard end of said second beam when said master cable drum is rotated in a second direction;

a first slave cable extending from a first end of said slave cable drum to a first end of said truncate rigid plate, said first slave cable adapted to lift said inboard end of said first beam when said slave cable drum is rotated in a first direction and to lower said inboard end of said first beam when said slave cable drum is rotated in a second direction;

a second slave cable extending from a second end of said slave cable drum to a second end of said truncate rigid plate, said second slave cable adapted to lift said inboard end of said second beam when said slave cable drum is rotated in a first direction and to lower said second beam when said slave cable is rotated in a second direction;

whereby the weight of a boat lifted and lowered by said boat lift is distributed substantially equally between said first and second master cables and said first and second slave cables; and whereby all of said cables are in synchronization with one another so that the boatlift is lifted and lowered in a level plane.

2. The boatlift of claim 1, wherein said truncate rigid plate is positioned on an inboard side of said inboard piling.

3. The boatlift of claim 1, further comprising:

a pair of parallel plates that are rotationally engaged and parallel to said truncate rigid plate;

a first inboard pulley rotatably mounted in sandwiched relation to said pair of parallel plate at a first end of said parallel plates;

a second inboard pulley rotatably mounted in sandwiched relation to said pair of parallel plate at a second end of said parallel plates;

said first and second inboard pulleys mounted for rotation about a horizontal axis.

4. The boatlift of claim 3, further comprising:

a first inboard roller rotatably mounted at an inboard end of said first beam;

a second inboard roller rotatably mounted at an inboard end of said second beam;

said first and second inbord rollers having a vertical axis of rotation.

5. The boat lift of claim 4, further comprising:

a first outboard pulley mounted to said first outboard piling near an upper end thereof; and a first anchor means secured to said first outboard piling in vertically downward spaced relation to said first outboard pulley.

6. The boat lift of claim 5, further comprising:

a second outboard pulley mounted to said second outboard piling near an upper end thereof; and a second anchor means secured to said second outboard piling in vertically downward spaced relation to said second outbaord pulley.

7. The boatlift of claim 6, wherein said first beam is a box beam having a hollow interior and wherein said second beam is a box beam having a hollow interior.

8. The boatlift of claim 7, further comprising:

a first rotatably mounted box beam roller positioned within said hollow interior of said first box beam; and a second rotatably mounted box beam roller positioned within said hollow interior of said second box beam.

9. The boatlift of claim 8, further comprising:

a first rotatably mounted outboard roller positioned at an outboard end of said first box beam; and a second rotatably mounted outboard roller positioned at an outboard end of said second box beam.

10. The boatlift of claim 9, wherein said first master cable extends along a path of travel from said first end of said master cable drum to said first inboard pulley, said first inboard roller, said first box beam roller, said first outboard roller, said first outboard pulley and said first anchor means.

11. The boatlift of claim 10, wherein said second master cable extends along a path of travel from said second end of said master cable drum to said second inboard pulley, said second inboard roller, said second box beam roller, said second outboard roller, said second outboard pulley and said second anchor means.

12. A four piling boatlift, comprising:

a pair of upstanding inboard pilings disposed in longitudinally spaced apart relation to one another;

a pair of upstanding outboard pilings disposed in transversely spaced apart relation to said inboard pilings and in longitudinally spaced apart relation to one another;

a first beam having an inboard end disposed in closely spaced relation to a first inboard piling of said pair of inboard pilings and an outboard end disposed in closely spaced relation to a first outboard piling of said pair of outboard pilings;

a second beam having an inboard end disposed in closely spaced relation to a second inboard piling of said pair of inboard pilings and an outboard end disposed in closely spaced relation to a second outboard piling of said pair of outboard pilings;

a first cable drum assembly mounted to said first inboard piling near an upper end thereof;

said first cable drum assembly including a longitudinally disposed master cable drum and a slave cable drum disposed in transversely spaced apart, parallel relation to said master cable drum, said master cable drum and said slave cable drum being disposed in a common horizontal plane;

a first motor means for rotating said master cable drum;

a first interconnecting means for translating rotation of said master cable drum into simultaneous and corresponding rotation of said slave drum;

a first master cable following a path of travel that includes a downward path from a first end of said master cable drum to an inboard end of said first beam, a substantially level path through a hollow interior of said first beam, exiting said first beam at an outboard end thereof, an upward path extending to a first outboard pulley mounted near a top of said first outboard piling, and a downward path to a first anchoring means secured to said first outboard piling so that reeling of said first master cable relative to said first cable drum lifts said first beam and so that unreeling lowers said first beam;

a second cable drum assembly mounted to said second inboard piling near an upper end thereof;

said second cable drum assembly including a longitudinally disposed second master cable drum and a second slave cable drum disposed in transversely spaced apart, parallel relation to said second master cable drum, said second master cable drum and said second slave cable drum being disposed in a common horizontal plane;

a second motor means for rotating said second master cable drum;

a second interconnecting means for translating rotation of said second master cable drum into simultaneous and corresponding rotation of said second slave drum;

a second master cable following a path of travel that includes a downward path from said second master cable drum to an inboard end of said second beam, a substantially level path through a hollow interior of said second beam, exiting said second beam at an outboard end thereof, an upward path extending to a second outboard pulley mounted near a top of said second outboard piling, and a downward path to a second anchoring means secured to said second outboard piling so that reeling of said second master cable relative to said second cable drum lifts said second beam and so that unreeling lowers said second beam;

a first slave cable having a first end secured to said first slave cable drum and a second end secured to an inboard end of said first beam;

a second slave cable having a first end secured to said second slave cable drum and a second end secured to an inboard end of said second beam;

whereby the weight of a boat lifted and lowered by said boat lift is distributed substantially equally between said first and second master cables and said first and second slave cables; and whereby all of said cables are in synchronization with one another so that the boatlift is lifted and lowered in a level plane.

* * * * *